United States Patent [19]

Held, Jr.

[11] 4,249,690

[45] Feb. 10, 1981

[54] COMPOSITE GAS FLUSH CAN

[75] Inventor: Louis E. Held, Jr., Florissant, Mo.

[73] Assignee: Container Corporation of America, Chicago, Ill.

[21] Appl. No.: 117,382

[22] Filed: Jan. 31, 1980

[51] Int. Cl.[3] ..... B65D 5/64
[52] U.S. Cl. ..... 229/5.5
[58] Field of Search ..... 229/5.5, 5.6, 4.5, 5.8

[56] References Cited

U.S. PATENT DOCUMENTS

| | | | |
|---|---|---|---|
| 1,443,043 | 1/1923 | Rose | 229/5.5 |
| 2,285,220 | 6/1942 | Morrell | 229/5.5 X |
| 3,734,393 | 5/1973 | Stump | 229/5.5 X |

*Primary Examiner*—Davis T. Moorehead
*Attorney, Agent, or Firm*—Richard W. Carpenter

[57] ABSTRACT

A composite can having a relatively thin flange member secured to the upper end of the can body for attachment to a closure member to aid in gas flushing the contents.

1 Claim, 4 Drawing Figures

COMPOSITE GAS FLUSH CAN

SUMMARY OF THE INVENTION

This invention relates to composite cans of the type having tubular paperboard bodies which are closed at the ends by relatively thin closure members seamed to the end edges of the body.

Many times it is desirable to protect the shelf life of the contents of cans of this type by evacuating the air and then back flushing the container with nitrogen or some other inert gas. In the case of metal cans this is conventionally done by partially crimping or staking the upper closure member on the container after it has been filled. With the closure member temporarily in place, the filled container is placed within a receptacle and subjected to a vacuum to withdraw the oxygen and then gas flushed or back filled with an inert gas. Because metal cans are relatively thin, as are the closures, it is possible to control the passage of gas into and out of the can in the area where the closure is temporarily secured to the upper end of the can body. It is extremely difficult to do this with a conventional composite can, because the greater thickness of the body wall of the can occupies so much space where it is connected to the edge of the closure that it is not possible to control the passage of gas therethrough.

Accordingly, it is an object of this invention to provide a composite can having a relatively thin flange member secured to the upper end of the can body for temporary and then permanent attachment to the closure in such a manner that will permit the passage of gas between the can body and closure.

A more specific object of the invention is the provision of a composite can having a one-piece cylindrical flange element fixedly secured to the upper end of the can body.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 1:
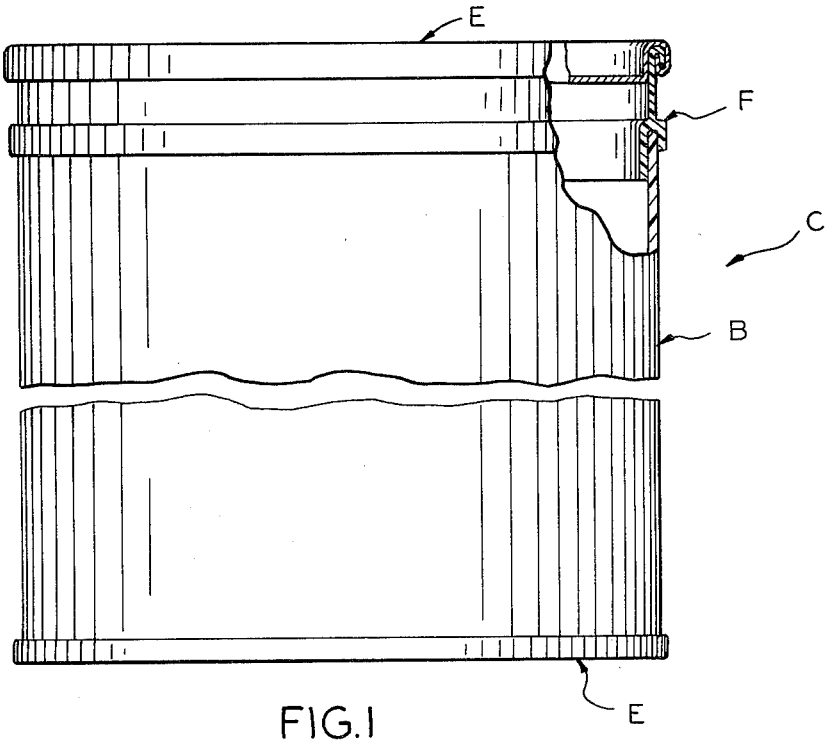
FIG. 1 is a side elevation, partially in section, of a composite can embodying features of the invention with the upper closure member attached thereto.

Referring now to the drawings for a better understanding of the invention, it will be seen that the composite can, indicated generally at C in FIG. 1, includes a tubular body B preferably formed of paperboard having a conventional end closure E secured to the lower end thereof and having secured to the upper end thereof a relatively thin cylindrical flange F to which in turn is attached the other end closure member E.

Figure 2:
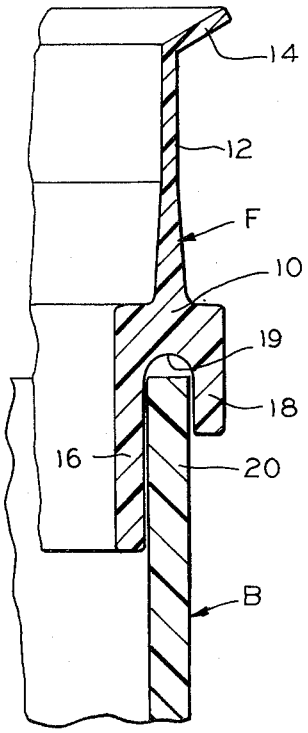
FIG. 2 is an enlarged view of a portion of the can body illustrated in FIG. 1 and showing the novel flange.

As previously mentioned, in order to provide a relatively thin body wall section for attachment to the upper end closure member E, there is provided a novel flange F illustrated in detail in FIG. 2. Flange F is preferably formed of a plastic material which may either be adhesively secured to the can body or molded directly on the upper end of the can body as desired.

Flange F, as seen in vertical cross section, is generally in the form of an inverted Y and includes a central section 10. Formed integrally with and extending upwardly from central section 10 is a relatively thin skirt 12 which in turn has projecting outwardly and upwardly from the upper end thereof an integrally formed rim 14 adapted for attachment to the edge 22 of closure E as illustrated in FIGS. 3 and 4.

Formed integrally with and projecting downwardly from central portion 10 of flange F are a pair of concentric inner and outer walls 16 and 18, respectively, which define therebetween an annular channel or groove 19 within which is received and secured the upper end 20 of can body B.

As previously stated the flange F may be secured to the can body by means of adhesive or may be molded directly on the end of the can body.

Figure 3:
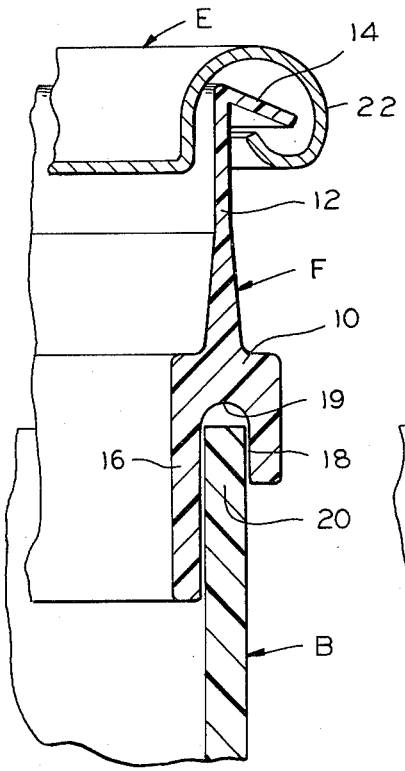
FIG. 3 is a view similar to FIG. 2 but illustrating the manner in which the end closure member is partially crimped or staked to the upper end of the can body.
Figure 4:
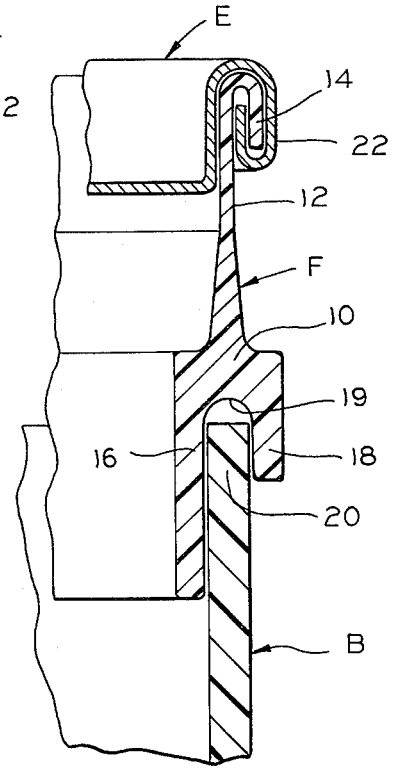
FIG. 4 is a view similar to FIG. 3 but showing the can after the closure member has been permanently seamed to the upper end of the can body.

As best seen in FIG. 3, when the peripheral edge 22 of upper closure E is partially crimped or staked over rim 14 of flange F, there is room for the passage of gas therebetween to facilitate a gas flushing operation. After such operation has been completed, the rim 14 and closure edge 22 may be permanently secured together as by double seaming in the conventional manner as illustrated in FIG. 4.

I claim:

1. A composite can, adapted for gas flushing the contents thereof, comprising:

(a) a tubular body open at the ends thereof and formed primarily of paperboard;

(b) one closure member secured to one end of said body;

(c) a generally cylindrical flange structure secured to the other end of said can body;

(d) said flange structure including:

(i) a pair of radially spaced inner and outer walls defining therebetween an annular groove within which is secured said other can body end;

(ii) a relatively thin skirt formed integrally with and extending upwardly from the juncture of said inner and outer walls;

(iii) said skirt having an integrally formed rim projecting upwardly and outwardly therefrom for attachment to another closure member;

(e) said other closure member being partially crimped so as initially to fit loosely over said flange and said rim to provide passage for flushing gas;

(f) said other closure member being subsequently secured to said flange and said rim at the conclusion of the flushing operation.

* * * * *